US006895691B2

(12) United States Patent
Laramore et al.

(10) Patent No.: US 6,895,691 B2
(45) Date of Patent: May 24, 2005

(54) APPARATUS AND METHOD FOR REMOVING ACCUMULATED, DRY SEEDS

(75) Inventors: Jerry Laramore, Meridian, ID (US); John Clark, Boise, ID (US)

(73) Assignee: Agra Air, Inc., Boise, ID (US)

( * ) Notice: Subject to any disclaimer, the term of this patent is extended or adjusted under 35 U.S.C. 154(b) by 0 days.

(21) Appl. No.: 10/606,005

(22) Filed: Jun. 24, 2003

(65) Prior Publication Data

US 2004/0237337 A1 Dec. 2, 2004

Related U.S. Application Data

(63) Continuation-in-part of application No. 10/448,152, filed on May 29, 2003.

(51) Int. Cl.[7] ..... F26B 17/00
(52) U.S. Cl. ..... 34/588; 34/582; 34/168
(58) Field of Search ..... 34/582, 583, 576, 34/579, 588, 167, 168

(56) References Cited

U.S. PATENT DOCUMENTS 3,298,793 A * 1/1967 Mallison et al. ..... 422/143
3,921,663 A * 11/1975 Beranek et al. ..... 137/533.11
4,064,636 A 12/1977 Downing
4,309,948 A * 1/1982 Zielinski ..... 110/263
4,841,884 A * 6/1989 Engstrom et al. ..... 110/298
5,391,356 A * 2/1995 Thorman ..... 422/143
5,893,218 A 4/1999 Hunter et al.

* cited by examiner

*Primary Examiner*—Denise L. Esquivel
*Assistant Examiner*—Kathryn S. O'Malley
(74) *Attorney, Agent, or Firm*—Holland & Hart LLP

(57) ABSTRACT

The present invention provides a seed dryer having an air kettle. The air kettle defines a seedbed. A plenum and diffuser direct air from an air supply to the bottom of the seedbed without the need for screens. The air from the air supply is provided with sufficient pressure that the seedbed is fluidized which decreases the need for mechanical agitation of the seeds. Dry seeds tend to accumulate on a surface of the seedbed. Removal of the accumulated seeds is facilitated by at least one perforation in and deflector cap that direct a portion of the air supply to a top surface of the seedbed.

14 Claims, 5 Drawing Sheets

APPARATUS AND METHOD FOR REMOVING ACCUMULATED, DRY SEEDS

RELATED APPLICATION

This application is a continuation-in-part of U.S. patent application Ser. No. 10/448,152, filed May 29, 2003, titled FLUIDIZED BED SEED DRYER.

FIELD OF THE INVENTION

The present invention relates to seed dryers and, more particularly, the present invention relates to an apparatus and method for reducing seed moisture content.

BACKGROUND OF THE INVENTION

In the agricultural industry, seeds are frequently harvested at moisture levels that inhibit safe and long term storage of the seeds. While high moisture content inhibits safe and long term storage, crops are harvested with moisture content to help prevent seeds degradation from things such as, for example, insects, diseases, exposures (such as weather), or the like.

The high moisture content of the harvested seeds inhibits safe, long-term storage. Thus, the high moisture seeds are artificially dried to bring the seeds down to an acceptable moisture level. The drying process occurs under controlled conditions to maximize the quality of the seed products. Controlled drying conditions are necessary because the rate and temperature of drying can influence the seeds' germination and storability.

One type of conventional apparatus and method for drying moist seeds includes placing the moist seeds in a bin. The moist seeds form a seedbed above a bottom of the bin. The bottom of the bin typically contains perforations or holes. Placing the bins over a plenum allows hot, dry air to be forced up through the perforations in the bottom of the bin and through the seedbed. The hot, dry air removes moisture from the moist seeds making them dry seeds. Alternatively, the bins can be placed in a drying chamber, here air is heated and circulated within the chamber, similar to an oven. In either case, the seeds need to be stirred or agitated to effectuate even drying. In some apparatuses, the bins are moved over various airflows using conveyor belts.

Another type of seed dryer is a two-pass dryer. A two-pass dryer typically has hot air from an upper plenum forced through the seeds from the top to the bottom. The air passes through the perforations in the bottom of the bin and enters a lower plenum. The pass through the seeds reduces the air temperature and increases the relative humidity. The lower temperature, higher humidity air from the lower plenum is directed to a second bin. The air passes through bottom perforations in the second bin, passes through a second seedbed from bottom to top and is typically exhausted to the atmosphere. Similar to the above, the seeds need to be stirred or agitated to effectuate even drying.

The perforations at the bottoms of the bins typically are as large as possible to permit maximum airflow with minimum resistance, but the size of the perforations is limited by the size of the seeds being dried. Thus, for a single dryer to dry multiple types of seeds, the perforations, which are typically contained in a screen, need to be changed with each seed change. Further, seeds still lodge in the perforations causing reduced flow and potential seed damage, and requiring cleaning of the perforations.

Thus it would be desirable to design an improved seed dryer.

SUMMARY OF THE INVENTION

To attain the advantages and in accordance with the purpose of the invention, as embodied and broadly described herein, an apparatus to remove dried, accumulated from a seed dryer is provided. The apparatus comprises perforations in a diffuser to allow air to flow to a deflector cap. The deflector cap and diffuser form an air path. Air from a plenum passes through the perforations and is directed by the deflector cap to the air path. The air facilitates the removal of accumulated seeds.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
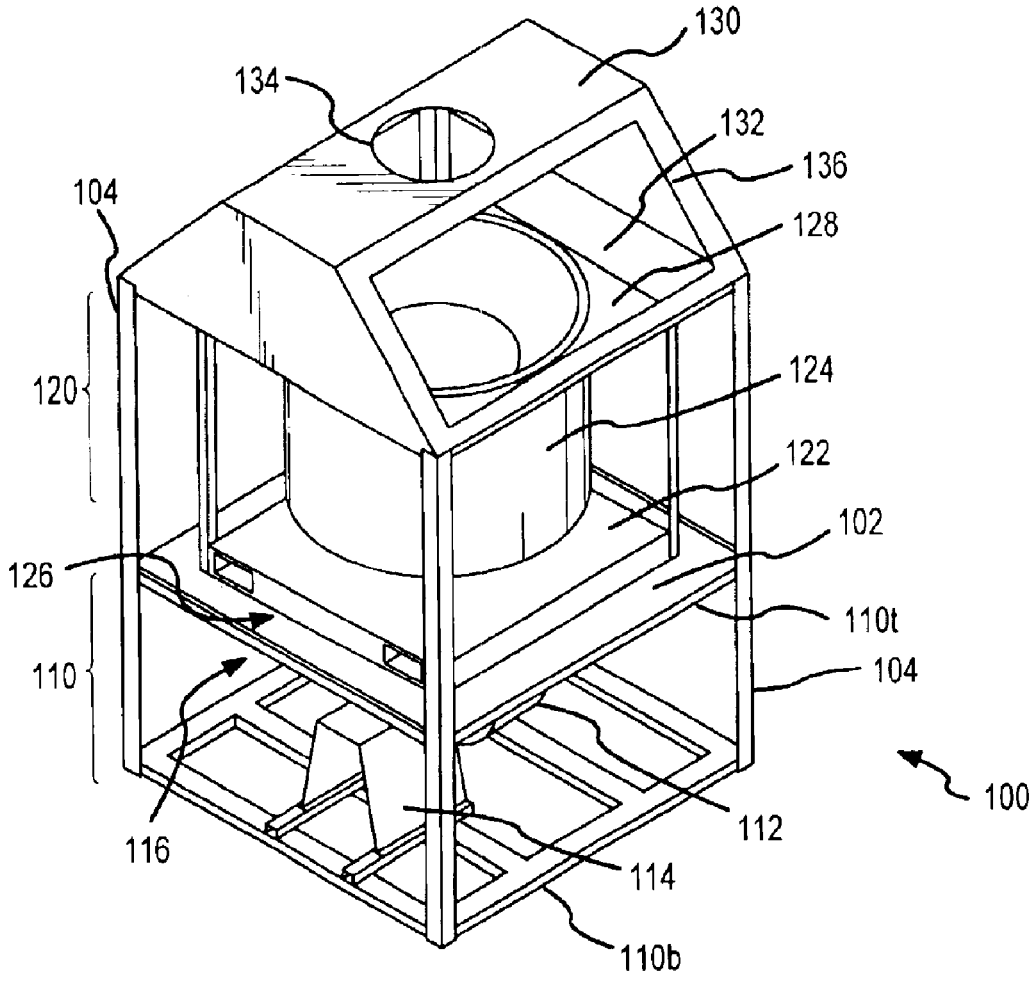
FIG. 1 shows a perspective view of a seed dryer consistent with at least one embodiment of the present invention.

The present invention will be described with reference to FIGS. 1–5. Referring first to FIG. 1, a seed dryer 100 is shown. Dryer 100 includes a fan compartment 110, a kettle compartment 120, and an exhaust hood 130. The compartments 110 and 120 are generally shown as open structures using supports 104, but could be enclosed by sidewalls if desired. Further, compartment 110, compartment 120, and exhaust hood 130 are described as separate units for convenience, but one of ordinary skill in the art would recognize on reading the below disclosure, dryer 100 could be a modular unit as described or a single integrated unit, or a combination thereof.

Fan compartment 110 includes a fan 112 (which is seen more clearly in FIG. 2) and a fan motor 114. Fan motor 114 receives power from a power source, such as from a conventional power line, generator, or battery source (not shown). A fan compartment airway opening 116 exists in the compartment top 110*t*. Fan 112 is connected to an air supply (not shown) and moves drying air from the supply and out of fan compartment 110 through airway opening 116. While air circulation is described using fan 112, other devices could be used such as, for example, a blower, jets, or the like. In this application the term air is used because hot, dry air is the conventional form of gas used to dry moist seeds; however, one of ordinary skill in the art would recognize after reading this disclosure that other gases could be used, so the term air should be used generically to mean any drying gas.

Kettle compartment 120 contains a kettle base 122, an air kettle 124, an air kettle airway opening 126, and an air kettle exhaust opening 128. Residing between fan compartment 110 and kettle compartment 120 is a gasket 102 or other sealant to inhibit leakage of the hot, dry air. Air kettle 124 contains a number of components that will be explained in more detail below.

Exhaust hood 130 contains an exhaust airway opening 132, a vent 134, and optionally, a viewing window 136. Viewing window 136 may be open, a clear surface, such as, glass or clear plastic, or a panel hingedly connected to exhaust hood 130.

Figure 2:
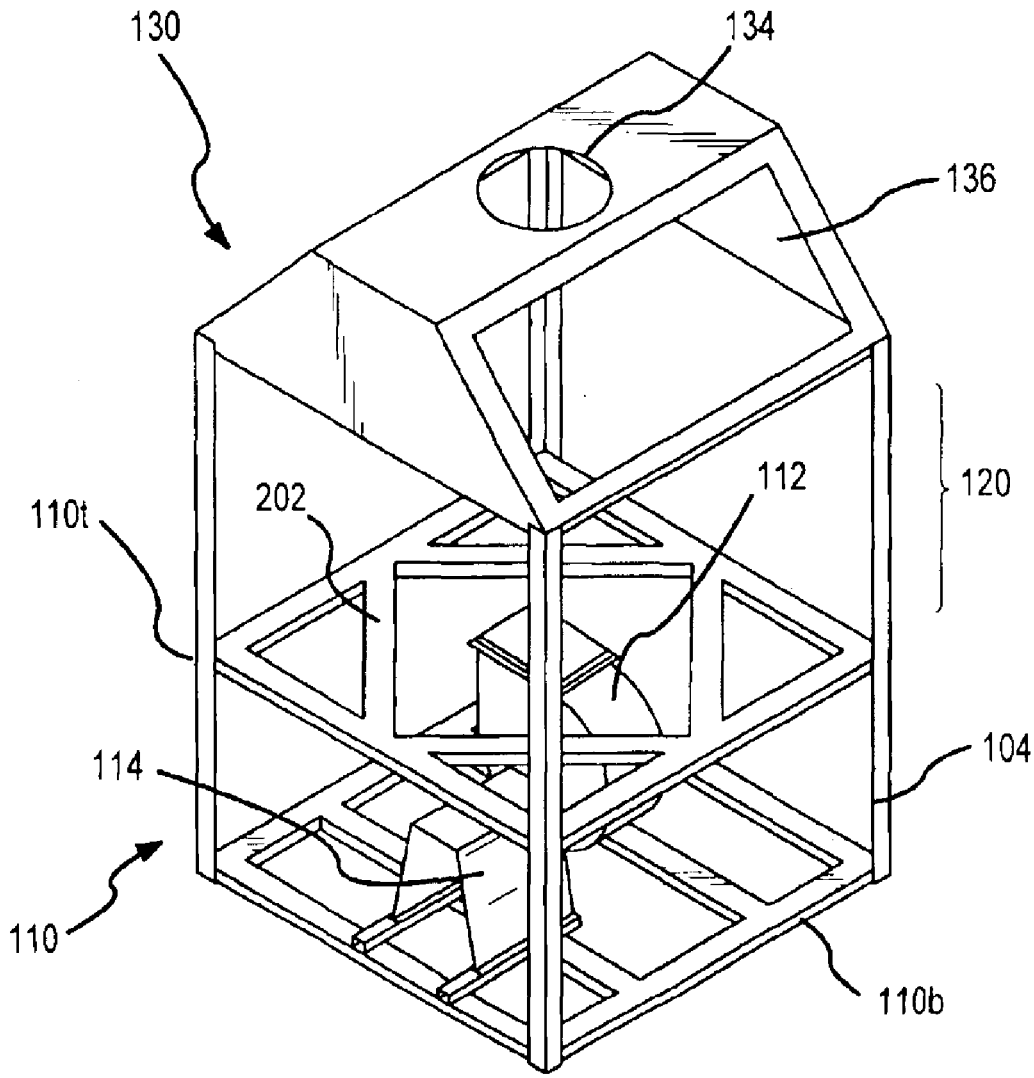
FIG. 2 shows a perspective view of the seed dryer with an air kettle and a kettle base removed consistent with at least one embodiment of the present invention.

As seen if FIG. 2, if dryer 100 is an integrated unit, then fan compartment top 110*t* is comprised of supports 202. Arrangement of supports 202 is such that kettle base 122 can rest on the supports above fan 112 such that airway opening 116 and 126 are substantially aligned.

Figure 3:
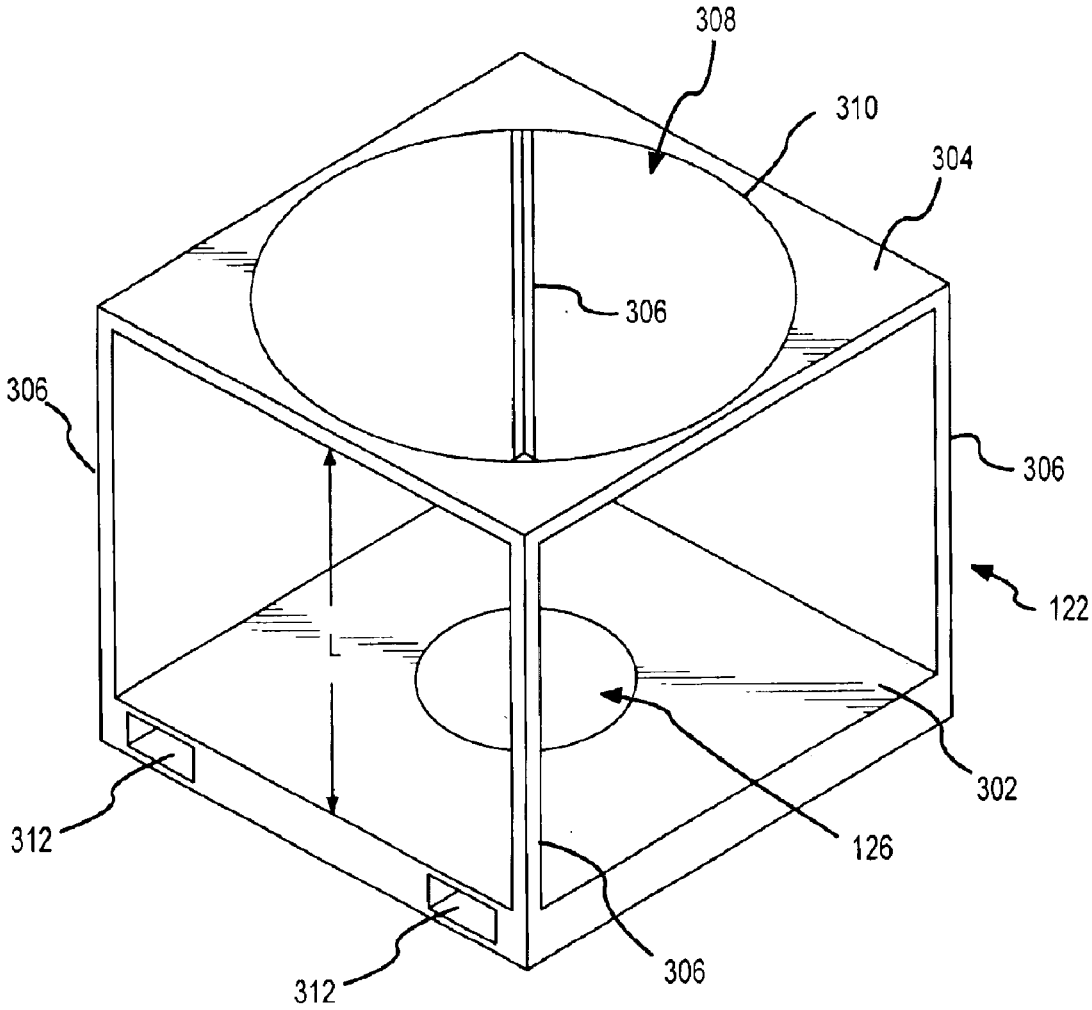
FIG. 3 is a perspective view of an air kettle base in accordance with at least one embodiment of the present invention.

Referring now to FIG. 3, a perspective view of kettle base 122 is shown in more detail. Kettle base 122 is shown as an open structure having a kettle base bottom 302 and a kettle base top 304. A plurality of supports 306 hold kettle base top 304 a distance L above kettle base bottom 302. Kettle base top 304 has an air kettle opening 308 defined by an edge 310. Kettle 124 (FIG. 1) resides in air kettle opening 308 and edge 310 provides some vertical stability. Kettle base airway opening 126 is arranged in kettle base bottom 302 such that placement of kettle base 122 in dryer 100 causes airways 116 and 126 to be substantially aligned. Optionally, to facilitate placement and removal, kettle base 302 may have one or more access ports 312. Access ports 312 are designed to receive, for example, fork lift prongs so that kettle base 122 can be removed from Dryer 100. Also, while shown as a substantially open frame device, kettle base 122 could have enclosed sidewalls. Also, opening 308 does not have to be circular but could be any geometric or random design to accept air kettle 124. Finally, but not shown, kettle base bottom 302 would have an attachment device, such as, bolt holes to mate with bolts, a slip ring, pin and detent, or the like, to allow air kettle 124 to fasten or releasably fasten to kettle base 122.

Figure 4:
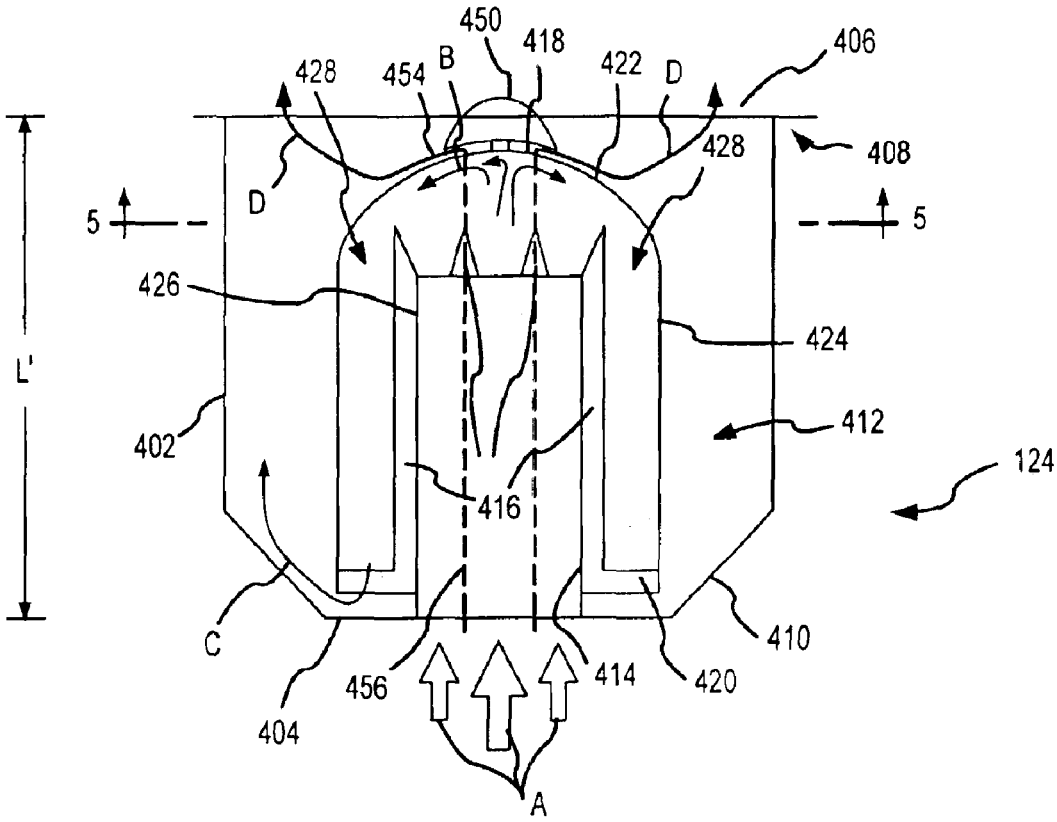
FIG. 4 is a cross-sectional view of an air kettle in accordance with at least one embodiment of the present invention.

Referring now to FIG. 4, a cross-sectional view of air kettle 124 is shown. Air kettle 124 has at least one kettle sidewall 402, a kettle bottom 404, and a kettle top 406 having a lip 408. Kettle bottom 404 is attached to kettle base 122 using a mechanism, such as bolts and bolt holes, a slip ring, a friction fit, a pin and detent, magnetics, or the like (none specifically shown). Sidewall 402 may have a sloped lower sidewall portion 410 to assist in airflow, as will be explained further below. While shown as a linear slope portion of the sidewall, sloped lower sidewall portion 410 could be arched, curved, or some other shape as a matter of design choice. If bottom 404 and sidewall 402 connected in a 90 degree angle, the air kettle would function, but the air flow would experience additional turbulence, which it is believed would reduce the efficiency of the dryer. Air kettle 124 has a vertical dimension of L'. L' should be slightly greater than L so that lip 408 resides above air kettle base top 304. Thus, sidewalls 402 and lip 408 are supported by top 304 and edge 310.

Internally, air kettle 124 comprises a seedbed 412, a plenum 414, and at least one air diffuser 418. Optionally, plenum 414 comprises at least one guide vane 416 and at least one air diffuser support 420. Diffuser 418 has outer walls 424 that fit outside walls 426 of plenum 414. Outer walls 424 of diffuser 418 and outside walls 426 of plenum 414 for air channel 428. In use, hot, dry air enters plenum 414 as shown by arrow A from fan 112 (FIGS. 1 and 2) and moves upward toward the top 422 of air diffuser 418. Top 422 is shown having a dome shape because that is believed to be the most efficient shape to equally spread the air flow in all directions, but other shapes are possible, such as, conical, triangular, elliptical, or the like. As shown by arrows B, when the hot, dry air strikes diffuser 418, the air flow is deflected towards the outer wall 424 of diffuser 418 and is guided downward by guide vanes 416 and outer wall 424. As shown by arrow C, the airflow exits underneath diffuser support 420 and curls up the lower sloped sidewall portion 410 and sidewall 402. As can be seen, while the above design is adequate, any geometric configuration would work as long as the air flow could be directed up, such as through plenum 414, directed downward, such as by top 422 of diffuser 418, and out bottom exit into seedbed 412.

While air kettle 124 having airflow from a fan up through plenum 414 as shown by Arrow A, off top 422 as shown by Arrow B, and back down channel 428 and into seedbed 412 as shown by Arrow C, it would be possible to supply air directly to channels 428 and out the bottom of seedbed 412. However, the arrangement shown in the FIGS. is believed to facilitate construction.

Airflow should be at a sufficient pressure and velocity to fluidize the seedbed to obtain even and effective seed drying. The pressures and velocities will depend on the seedbed composition, in part, and the shape of the air kettle, in part. Eventually, the airflow will exit the air kettle and escape the system via the exhaust airway opening 134.

Figure 5:
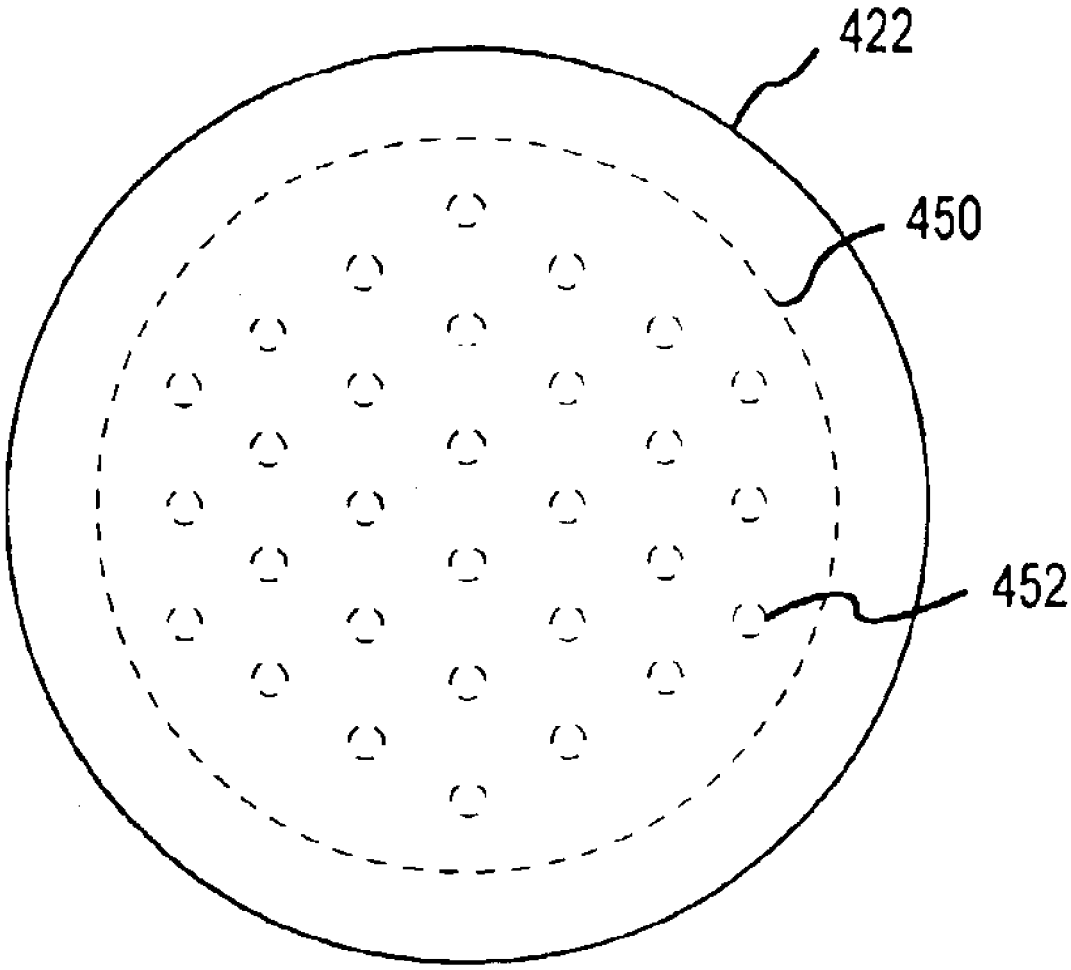
FIG. 5 shows a plan view of an internal surface of one type of diffuser constructed in accordance with FIG. 4.

While the above described air dryer is sufficient, it has been discovered that dry seeds have a tendency to accumulate on the upper surface of the seedbed and diffuser top 422. Because these seeds are dry, it would be beneficial to remove them from circulation. Referring now to FIGS. 4 and 5, a deflector cap 450 is shown. Deflector cap 450 would be coupled to top 422 of diffuser 418. One or more holes or perforations 452 would allow to pass through top 422 into an air gap 454 (which could also include one or more blowers, fans, nozzles, or jets) or provided between deflector cap 450 and top 422. Air would travel as shown by arrow D along top 422 and the upper surface of the seedbed to remove accumulated dry seeds. The number, size, and pattern of holes or perforations 452 would be determined by the amount of air flow necessary to remove the accumulated seeds. While shown as a pattern of circular perforations, perforations 452 could be placed in a random or irregular pattern and be any geometric shape (including combinations of geometric shapes), random, or irregular shape. Also, instead using hot, dry air in plenum 414, a separate accumulated seed removal air supply plenum 456 (shown in phantom) could be provided. The air supply (not shown) to plenum 414 and accumulated seed removal air supply plenum 456 could be the same supply or different supplies. If different supplies, the pressures and velocities of the air supply could be regulated for the different functions. In other words, a first air supply could supply air at a pressure and velocity sufficient to fluidize the seedbed and the second air supply could supply air at a different pressure and velocity sufficient to remove accumulated seeds.

Again, air flow could be from a supply where air is directed down through the plenum and out as shown by Arrow C. In this case, a domed, shaped top would have perforations to split the air such that the air traveling through the perforations would eventually exit to fluidize and dry the seedbed. The split air would travel down the dome top and facilitate the removal of accumulated seeds.

Referring back to FIG. 4, because of the airflow pattern, pressure and velocity, no screens are necessary for operation of dryer 100. A screen could be used, such as a screen mounted between adjacent diffuser supports 420, but because seeds in seedbed 412 cannot contaminate fan 112 or the air supply, screens are not necessary. Also, because air travels underneath seedbed 412, seeds are mixed by the airflow to facilitate even and complete drying. Thus, removing the need for mechanical agitation or stirring.

FIG. 4 represents a symmetrical air kettle 124 because it is believed to be an efficient design, but it would be possible to have asymmetrical air kettles. For example, the plenum and diffuser could be offset. Moreover, while a single, central plenum and diffuser are shown, multiple plenums and diffusers could be used. If multiple plenums and diffusers are used, they could be arranged randomly, but it would be beneficial to arrange the plenums and diffusers about a geometric center axis of air kettle 124.

While the invention has been particularly shown and described with reference to an embodiment thereof, it will be understood by those skilled in the art that various other changes in the form and details may be made without departing from the spirit and scope of the invention.

We claim:

1. An apparatus to facilitate removal of seeds from a top of an air bed, comprising:

an air kettle for a seed dryer where the air kettle has at least one plenum and such that the air to dry seeds fluidizes a seedbed to provide seed drying and, further comprising: and at least one air path, the at least one air path formed between the at least one diffuser and the at least one deflector cap, wherein air from an air supply travels through the at least one perforation and is directed through the at least one air path by the deflector cap such that removal of dry seeds is facilitated by the air.

2. The apparatus according to claim 1, further comprising:

at least one accumulated seed removal air supply plenum, wherein the at least one accumulated seed removal air supply plenum couples an air supply to the at least one perforation.

3. The apparatus according to claim 1, wherein the at least one air path further comprises at least one of a fan, a blower, a nozzle, and a jet.

4. The apparatus according to claim 1, wherein the at least one perforation comprises a plurality of perforations.

5. The apparatus according to claim 4, wherein the plurality of perforations are arranged in a pattern about a central geometric axis of the at least one diffuser.

6. The apparatus according to claim 4, wherein the plurality of perforations reside substantially aligned with the at least one deflection cap.

7. The apparatus according to claim 1, wherein the at least one perforation is cylindrical.

8. The apparatus according to claim 1, wherein the at least one perforation is shaped, the shape being at least one of a group of shapes comprising: a cylindrical shape, a conical shape, a cubic shape, and an hourglass shape.

9. A kettle for use in a seed dryer, the kettle comprising:

a sidewall, a kettle top, and a kettle bottom;

the sidewall, the kettle top, and the kettle bottom defining a seedbed;

at least one plenum, the at least one plenum comprising an air supply opening, outside walls, and an air supply exhaust, the outside walls defining an air supply path;

the at least one plenum residing in the seedbed such that the air supply opening resides towards the kettle top and the air supply exhaust resides towards the kettle bottom;

at least one located about the air supply opening the at least one plenum.

10. The kettle according to claim 9, wherein the at least one perforation comprises a plurality of perforations.

11. The kettle according to claim 9, wherein the first portion of the air supply travels through at least one of a nozzle, a jet, and a blower.

12. The kettle according to claim 9, wherein the at least one deflector cap comprises at least one perforation to split the air supply into a first portion and a second portion.

13. A seed dryer comprising:

a air supply; and a kettle, the kettle having a bottom, a top, and a sidewall all of which define a seedbed;

means for supplying drying air from the air supply to the bottom of the kettle, such that the supplied air fluidizes the seedbed to assist in even drying of moist seeds contained in the seedbed; and means for supplying accumulated seed removal air to a surface of the seedbed to facilitate the removal of accumulated seeds, wherein means for supplying drying air comprises at least one plenum and at.

14. The seed dryer according to claim 13, wherein the means for supplying accumulated seed removal air comprises an accumulated seed removal air supply plenum and a deflector cap.

* * * * *